US005092531A

United States Patent [19]

Grecksch et al.

[11] Patent Number: 5,092,531

[45] Date of Patent: Mar. 3, 1992

[54] ASSEMBLY FOR PREPARING YARN ENDS OF YARN PACKAGES FOR UNWINDING AT A TEXTILE WINDING MACHINE

[75] Inventors: Hans Grecksch; Ulrich Wirtz, both of Moenchengladbach; Helmut Kohlen, Erkelenz; Paul Surkamp, Kempen; Helmuth Hensen, Moenchengladbach, all of Fed. Rep. of Germany

[73] Assignee: W. Schlafhorst AG & Co., Moenchengladbach, Fed. Rep. of Germany

[21] Appl. No.: 538,936

[22] Filed: Jun. 15, 1990

[30] Foreign Application Priority Data

Jun. 15, 1989 [DE] Fed. Rep. of Germany ..... 3919526

[51] Int. Cl.[5] ..... B65H 54/00

[52] U.S. Cl. ..... 242/18 R; 242/35.5 A

[58] Field of Search ..... 242/35.5 A, 35.5 R, 242/35.6 E, 18 R

[56] References Cited

U.S. PATENT DOCUMENTS 4,544,107 10/1985 Matsui et al. ..... 242/35.5 A 4,576,341 3/1986 Matsui et al. ..... 242/35.5 A 4,681,271 7/1987 Matsui et al. ..... 242/18 R

*Primary Examiner*—Stanley N. Gilreath

*Attorney, Agent, or Firm*—Shefte, Pinckney & Sawyer

[57] ABSTRACT

A yarn end preparing assembly for a textile winding machine wherein yarn packages are disposed on peg tray-type tube support members and transported to winding stations along a common preliminary path to a respective one of a plurality of yarn end preparation devices which have components for sequentially handling the yarn packages to dispose their yarn ends in preferred preliminary dispositions. The yarn end preparation devices are each disposed on a respective branch path which branches the common preliminary path. The relationship of the branch path to one another can be varied and the relationship of each component of the yarn end preparation devices relative to the same respective component on the other yarn end preparation devices can be varied to optimize the production capability of the yarn end preparing assembly. Sensors and pivotable arm members are provided to selectively guide the tube support members to the branch paths.

9 Claims, 3 Drawing Sheets

FIG. 7
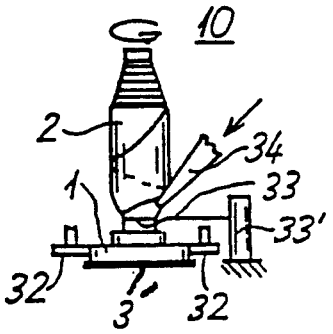
FIG. 8
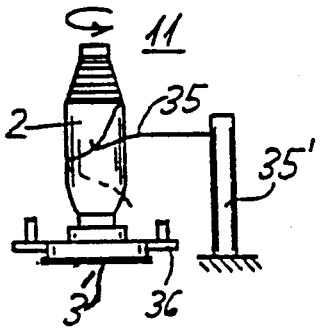
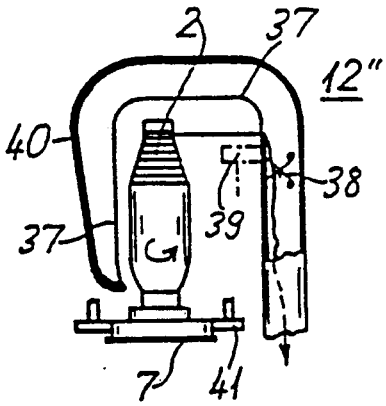
FIG. 9
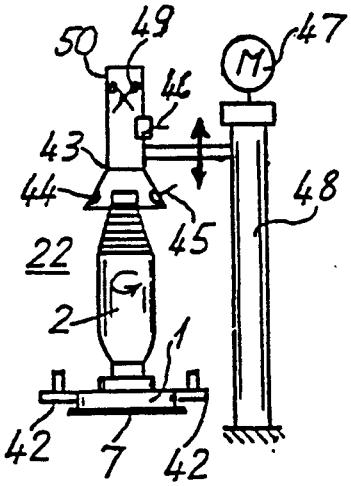
FIG. 10

ASSEMBLY FOR PREPARING YARN ENDS OF YARN PACKAGES FOR UNWINDING AT A TEXTILE WINDING MACHINE

BACKGROUND OF THE PRESENT INVENTION

The present invention relates to an assembly for preparing the yarn ends of yarn packages which are individually transported for unwinding at a textile winding machine.

Due to improvements in the production speed of spinning machines which build yarn packages onto tubes for subsequent unwinding by textile winding machines in the next following textile operation, it is desirable to implement corresponding increases in the production capacity of textile winding machines to avoid production bottlenecks at :he textile winding machines. It is already known to provide a plurality of winding stations on a textile winding machine for concurrently unwinding a plurality of yarn packages delivered to the winding machine from, for example, a full yarn package reserve supply or directly from a spinning machine associated with the textile winding machine. In this regard, each yarn package delivered to a winding station must typically have its yarn end prepared for winding engagement by the winding station.

A number of devices are known for preparing the yarn ends of yarn packages which have been delivered to a textile winding machine enroute to a winding station for unwinding of the yarn package thereat. In Japanese patent document 50-136 440 a yarn end preparation device is disclosed which is located at an end of a spinning machine adjacent an associated textile winding machine. The yarn packages delivered to the yarn end preparation device are each built on tubes which are individually supported on pegs in upright dispositions and the spacing between the yarn packages is generally uniform. The average time for preparing the yarn end of a yarn package corresponds to the rate of transfer of the yarn packages to the associated textile winding machine. If the rate of transfer is set at a relatively high rate, the average time for preparing the yarn end of each yarn package must be correspondingly relatively short, thereby detrimentally increasing the risk that an unacceptable number of the yarn packages will not have their yarn ends adequately prepared by the yarn end preparation device. Accordingly, the need exists for a device for preparing the yarn ends of yarn packages for winding engagement by the winding stations of the textile machine which can reliably prepare the yarn ends of a sufficient number of packages within a predetermined unit of time to minimize production bottlenecks in the integrated operation of a spinning machine and an associated textile winding machine.

SUMMARY OF THE INVENTION

By the present invention a plurality of yarn end preparation means are provided so that a plurality of yarn end preparation means can operate concurrently on a plurality of yarn packages, thereby increasing productivity while allowing each yarn package to be subjected to sufficient yarn end preparation for reliable results in an integrated operation of a spinning machine and associated textile winding machine.

Briefly described, the present invention provides an assembly for a textile winding machine of the type having a plurality of winding stations at which yarn is wound from yarn packages on tubes individually supported on tube support members of the type that individually transport yarn packages to the winding stations for unwinding thereat and subsequently transport tubes from the winding stations. The assembly prepares the yarn ends of the yarn packages for unwinding engagement at the winding stations and includes a plurality of yarn end preparation means. Each yarn end preparation means is operable to prepare for unwinding engagement the yarn end of a yarn package different from the yarn packages prepared at the other of the plurality of yarn end preparation means and the plurality of yarn end preparation means are operable concurrently. The assembly also includes means defining a delivery path for transporting tube support members with yarn packages supported thereon to the plurality of yarn end preparation means and means defining an exit path for transporting tube support members with yarn packages supported thereon from the yarn end preparation means.

According to one aspect of the present invention, the assembly also includes a feed component, operatively connected to the delivery path and the exit path, for supporting tube support members at the yarn end preparation means for yarn end preparation of yarn packages supported on the tube support members. The feed component includes temporary retaining means for independently selectively retaining tube support members at each of the yarn end preparation means during yarn end preparation of the yarn packages supported on the retained tube support members. The feed component includes means for advancing tube support members through the yarn end preparation means, and the temporary retaining means is operable independently of the advancing means for temporarily retaining tube support members advanced to the yarn end preparation means by the advancing means.

According to a different aspect of the present invention, the delivery path means includes a common preliminary path for transporting tube support members from a yarn package receiving location and a plurality of branch paths branched from the common preliminary path. The branch paths transport tube support members through respective ones of the yarn end preparation mean. Also, the exit path means includes a common downstream exit path and a plurality of branch exit paths each extending between one of the yarn end preparation means and the common downstream exit path for transporting tube support members from a respective one of the yarn end preparation means to the common downstream exit path.

In one variation of the different aspect of the present invention, the plurality of branch paths extend generally parallel to one another through the yarn end preparation means. Also, in the one variation, the branch exit paths extend generally parallel to one another from the yarn end preparation means.

According to yet another aspect of the present invention, each of the yarn end preparation means includes a plurality of components arranged for sequential individual handling of yarn packages transported through the yarn end preparation means.

In the one variation of the different aspect of the present invention, each of the yarn end preparation means includes a plurality of components arranged in spaced relation to one another for sequential individual handling of yarn packages supported en tube support members advanced through the yarn end preparation means, each the component of the yarn end preparation means being operable to perform a different yarn end preparation step. Also, in one aspect of the variation the same respective components of all of the yarn end preparation means are generally aligned with one another transverse to the direction of travel of tube support members through the yarn end preparation means.

According to another aspect of the one variation of the present invention, the components of each the yarn end preparation means are offset from the same respective components of an adjacent yarn end preparation means.

According to further features of the different aspect of the present invention, at least one of the branch paths is transversely offset from the common preliminary path and is interconnected thereto by an interconnecting path, the length of the interconnecting path between the common preliminary path and the at least one branch path being greater by at least a factor of two than the tube support member cross-sectional extent. Additionally, a selected one cf the branch paths is aligned with the common preliminary path. The other feature includes sensing means located adjacent the selected one of the branch paths upstream from the respective yarn end preparing means associated with the selected branch path for sensing the presence of a tube support member at a predetermined upstream location, and diverting means. The diverting means is operatively connected to the sensing means for diverting tube support members from the common preliminary path onto the interconnecting path in response to sensing by the sensing means of a tube support member at the predetermined upstream location on the selected branch path.

The assembly of the different aspect of the present invention also includes the features that at least two of the branch paths are offset from the common preliminary path and are interconnected thereto by the interconnecting path and second sensing means located relative to the respective one of the offset branch paths which communicates with the interconnecting path upstream of the other offset branch path for sensing the presence of a tube support member at a predetermined location upstream relative to the respective yarn end preparation means of the respective one of the offset branch paths. The assembly further includes second diverting means, operatively connected to the second sensing means, movable from a clearance position out of interference with the interconnecting path for permitting passage of tube support members therepast toward the other of the offset branch paths and a diverting position transverse to the interconnecting path for diverting tube support members from the interconnecting path onto the respective one of the offset branch paths. The second sensing means controls the second diverting means to be disposed in its clearance position in response to sensing by the sensing means of a tube support member at the predetermined upstream location.

In yet an additional aspect of the present invention, the exit path means defines an exit path component for each of the yarn end preparation means, each the exit path component being separate from the other exit path component.

In a further different aspect of the present invention, the delivery path means includes a common delivery path, and the plurality of yarn end preparing means are sequentially disposed along the common delivery path.

According to a further additional aspect of the present invention, an assembly is provided for a textile winding machine of the type having a plurality of winding stations at which yarn is wound from yarn packages on tubes individually supported on tube support members of the type that individually transport yarn packages to the winding stations for unwinding thereat and subsequently transport tubes from the winding stations. The assembly prepares the yarn ends of the yarn packages for unwinding engagement at the winding stations and includes yarn end preparation means operable to prepare for unwinding engagement the yarn ends of yarn packages and means defining a delivery path for transporting tube support members with yarn packages supported thereon to the yarn end preparation means. The delivery path means includes a common preliminary path for transporting tube support members from a yarn package receiving location and a plurality of branch paths branched from the common preliminary path. The branch paths transport tube support members through the yarn end preparation means.

The assembly of the further additional aspect of the present invention also includes the feature that the yarn end preparing means is disposed relative to at least two of the branch paths to prepare yarn ends of packages being transported in the at least two branch paths. Also, the assembly includes means defining an exit path for transporting package support members with yarn packages supported thereon from the yarn end preparation means.

BRIEF DESCRIPTION OF THE DRAWINGS

FIG. 7 is a front elevational view of one type of component of a yarn end preparation device of the yarn preparing assembly of the present invention for performing one step of the yarn end preparing process;

FIG. 8 is a front elevational view cf another type of component of a yarn end preparation device of the yarn end preparing assembly of the present invention for performing one step of the yarn end preparing process:

FIG. 9 is a front elevational view, in partial vertical section, of yet another type of component of a yarn end preparation device of the yarn end preparing assembly of the present invention for performing one step of a yarn end preparing process; and FIG. 10 is a front elevational view of a further additional type of component of a yarn end preparation device of the yarn end preparing assembly of the present invention for performing one step of a yarn end preparing process.

DETAILED DESCRIPTION OF THE PREFERRED EMBODIMENTS

In each of the FIGS. 1–6, a respective embodiment of the yarn end preparing assembly of the present invention is illustrated. Each respective embodiment of the yarn end preparing assembly illustrated in FIGS. 1–6 includes a plurality of yarn end preparation devices having components which are described with respect to FIGS. 7–10.

Figure 1:
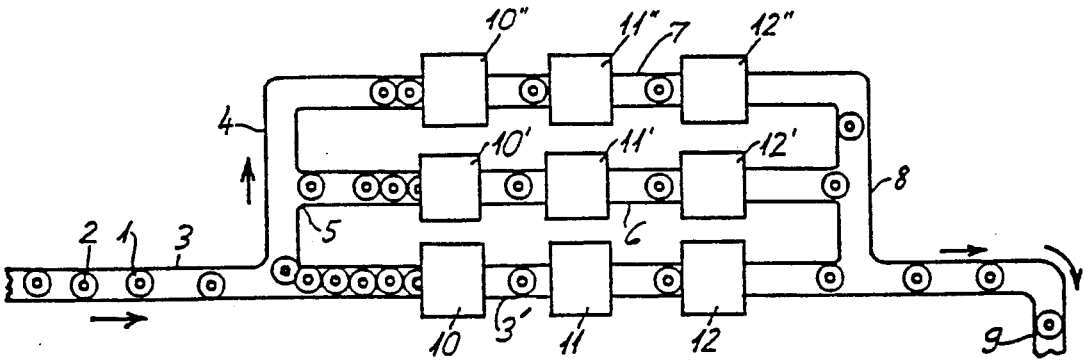
FIG. 1 is a schematic plan view of one embodiment of the yarn end preparing assembly of the present invention.

A textile winding machine (not shown) is continuously supplied with fresh yarn packages from a yarn package reserve supply (not shown) or directly from a spinning machine (not shown) associated with the textile machine The textile winding machine includes a plurality of winding stations for concurrently unwinding yarn from the yarn packages in operation of the winding machine. The yarn packages may be of the type wound onto tubes which are supported in upstanding dispositions on conventional peg tray-type tube support members. For example, as seen in FIG. 1, a plurality of tube support members 1 are provided for individually supporting yarn packages 2 which are built onto tubes at the associated spinning machine. The yarn packages 2 are supported on the tube support members I during transport thereof to the winding stations for unwinding of the yarn packages thereat.

In accordance with the present invention, an assembly is provided for preparing the yarn ends of the yarn packages 2 for winding engagement at the winding stations of the textile winding machine. With reference to the embodiment illustrated in FIG. 1, the assembly of the present invention for preparing the yarn ends of the yarn packages 2 for unwinding engagement at the winding stations includes a plurality of yarn end preparation means, a delivery path for transporting the tube support members 1 with yarn packages 2 supported in upright dispositions thereon from a yarn package receiving location (not shown) at which the yarn packages 2 are disposed on the tube s members 1, a means for supporting the tube support members 1 at the plurality of the yarn end preparation means. Also, the assembly includes an exit path for transporting the tube support members 1 from the supporting means following preparation of the ends of the packages 2 by the yarn end preparation means. Each yarn end preparation means includes a plurality of components for sequentially preparing the yarn ends of a yarn package in sequence during the transport of the yarn packages 2 through the yarn end preparation means and is operable to prepare for unwinding engagement the yarn end of a yarn package different from the yarn packages prepared at the other yarn end preparation means. Additionally, the yarn end preparation means are operable concurrently to concurrently prepare the yarn ends of a plurality of yarn packages 2.

The delivery path for transporting the packages support members 2 is comprised of a common preliminary path 3 along which all of the tube support members 1 are transported to the supporting means. In the embodiment of FIG. 1, the supporting means includes an interconnecting path 4 and a plurality of branch paths, each branch path being arranged for transporting tube support members 2 to a respective one of the yarn end preparation means. One of the branch paths is aligned with the common preliminary path and connected to the downstream end of the common preliminary path 3. The interconnecting path 4 extends from this aligned branch path and the other two branch paths extend therefrom at an offset from the common preliminary path. The branch paths extend generally parallel to one another through the yarn end preparation means.

The exit path for transporting the tube support members 1 from the yarn end preparation means includes an exit interconnecting path 8 and a common downstream exit path 9 having an upstream end connected to the downstream end of the one aligned branch path. The downstream end of the two offset branch paths are connected to the exit interconnecting path 8 and the downstream end of the path 8 is connected to the aligned branch path.

Each yarn end preparation means includes a plurality of components for successively performing different yarn end preparation steps which cumulatively result in the disposition of the handled yarn end in a preferred preliminary disposition for engagement by a winding station. The yarn end preparation means associated with the respective branch path aligned with the common preliminary path 3 includes a plurality of components 10, 11 and 12. The branch path positioned intermediately the aligned branch path and the outer branch pair communicates with the interconnecting path 4 at the first upstream junction along the interconnecting path 4 relative to the direction of transport along the interconnecting path and is operable to transport the tube support members 1 to the yarn end preparation means having a plurality of components 10′, 11′ and 12′. The outer branch path communicates with the interconnecting path 4 at a location further downstream relative to the intermediately positioned branch path for transporting the tube support members 1 to the yarn end preparation means having a plurality of components 10″, 11″ and 12″.

Each branch path of the supporting means forms a processing segment extending through a respective one of the yarn and preparation means for supporting a tube support member 1 during yarn end preparation of the yarn package 2 supported on the tube support member 1. The aligned branch path forms a processing segment 3′ extending between the components 10-12 of the yarn end preparation means associated with the branch path aligned with the common preliminary path and the common exit path 9. The intermediately positioned branch path forms a processing segment 6 extending between the components 10′-12′ of the yarn end preparation means, The outer branch path forms a processing segment 7 extending between the components 10″-12″ of the yarn end preparation means.

Each branch path has a transport extent which is greater by at least a factor of two than the cross-sectional extent of a tube support member 1 to provide the branch path with the capability to support several tube support members 1 advanced onto the respective branch paths.

The interconnecting path 4 can be, for example, the travel path of a conventional endless belt. The belt preferably has a lateral extent transverse to its endless extent which is relatively less than the diameter of a tube support member 1. Each associated branch path can be formed by, for example, a conventional belt. The upstream end of the belt is positioned sufficiently adjacent the interconnecting path 4 for urging the tube support members 1 supported on the belt of the interconnecting path 4 to transfer onto the belt of the respective branch path for transport therealong. A smooth transfer of tube support members 1 from the interconnecting member 4 onto the respective branch path belts is ensured due to the overlapping disposition of the tube support members 1 on the belt defining the interconnecting path 4.

The exit interconnecting path 8 can be defined, for example, by a conventional endless belt having a lateral extent transverse to its endless extent less than the diameter of a tube support member 1. The belt defining the exit interconnecting path 8 is positioned adjacent the respective downstream ends of the belts extending through the yarn and preparation means such that tube support members 1 are smoothly transferred from these endless members onto the exit interconnecting path 8. The common downstream exit path 9 can be defined, for example, by a plurality of conventional, operatively interconnected endless belts.

In the embodiment in FIG. 1, the same respective components of each yarn end preparation means are aligned with one another transverse to the direction of travel of the tube support members 1 through the yarn end preparation means. For example, all of the first components 10, 10' and 10'' of the yarn end preparation means for initially handling the yarn packages 2 are aligned with one another, as are all of the second components 11,11' and 11'' and all of the third components 12,12' and 12''.

Each yarn end preparation means includes temporary retaining means for independently selectively retaining tube support members during yarn end preparation. For example, as seen in FIG. 7, each first yarn end preparation component 10,10',10'' preferably includes three rotating disk members 32 (only two of which are illustrated) cooperatively disposed relative to one another and movable toward and away from the tube support members for selectively retaining and releasing a tube support member 1 at a yarn end disposing location. A mechanical yarn end loosener such as, for example, a relatively rigid stripping arm 33, is supported by a post 33' for pivoting into engagement with a full yarn package 2 supported on a tube support member 1 which is retained by the rotating disk members 32 at the first yarn end disposing location. A conventional forced air jet device 34 has its mouth positioned adjacent the lower end of the full yarn package 2 for jetting air on the yarn package to facilitate loosening of a yarn end thereof in conjunction with the operation of the stripping arm 33. The rotating disk members 32 are cooperatively rotated in engagement with the circumferential periphery of the tube support member 1 to effect rotation of the yarn package 2 in an unwinding direction during engagement of the yarn package by the stripping arm 33.

As shown in FIG. 8, each second yarn end preparation component 11,11',11'' preferably includes three rotating disk members 36 (only two of which are illustrated) and a mechanical yarn end loosening device such as, for example, a stripper arm 35 supported for pivoting at a selected axial height relative to the yarn package 2 by a post 35'. The rotating disk members 36 are cooperatively rotated in engagement with the circumferential periphery of the tube support member 1 to effect rotation of the yarn package 2 in an unwinding direction while the stripper arm 35 engages the yarn package. The arm 35 momentarily engages the yarn end to loosen the yarn end in preparation for the next yarn end handling step. Following the loosening of the yarn end by the stripping arm 35, the rotating disk members 36 are moved out of interference with the tube support member 1 to permit further transport of the tube support member 1 to the third yarn end preparation component 12,12',12''.

As seen in FIG. 9, each third yarn end preparation component 12,12',12'' for performing the final yarn end preparation step performed by the respective yarn end preparation means preferably includes three rotating disk members 41 (only two of which are illustrated) and a conventional yarn end suction device 40 having a slot 37 therein for applying a suction axially along the yarn package 2 to engage the previously loosened yarn end thereof. The yarn end suction device 40 additionally includes a conventional yarn end cutting device 38 and a conventional sensor 39 for controlling the cutting action of the yarn end cutting device 38. After the tube support member I has been engaged by the rotating disk members 41 to retain the tube support member at a yarn end disposing location, the yarn end suction device 40 is operated to draw the loosened yarn end into its slot 37 and downwardly past the cutting device 38. The sensor 39 senses the presence of the yarn end and controls the operation of the yarn end cutting device 38 to cut the yarn end. Thereafter, the rotating disk members 41 are operated to rotate the yarn package 2 in the winding direction to wind the now-cut yarn end back onto the yarn package. The yarn end is now disposed in a preferred preliminary disposition for ready engagement at one of the winding stations to initiate winding of the yarn package 2. The disk members 41 then move out of interference with the tube support member to permit it to proceed downstream to the winding stations.

The operation of the embodiment of the assembly of the present invention shown in FIG. 1 is as follows.

The tube support members 1 are transported along the common preliminary path 3 from the yarn package receiving location, each tube support member 1 supporting a yarn package 2 in an upright disposition. The leading tube support member 1 is transported directly into the first component 10 of the yarn end preparation means associated with the branch path aligned with the common preliminary path 3 and preparation of the yarn end of the respective yarn package 2 supported thereon is commenced. The trailing tube support members 1 are moved into serial abutment with one another and thereby eventually fill the aligned branch path with the tube support members to the extent that the next oncoming tube support member 1 being transported along the common preliminary path 3 is directed by contact with the preceding tube support member into the interconnecting path 4. In a similar manner, the next trailing tube support member 1 is directed to the interconnecting path 4. In this manner, each time the branch path aligned with the common preliminary path 3 is fully loaded with tube support members 1, each subsequent tube support member 1 is diverted into the interconnecting path 4, and ultimately travels along the interconnecting path 4.

The belt of the intermediately located branch path engages those tube support members 1 being transported thereto by the interconnecting path 4 and transports these engaged tube support members to the first component 10' of the associated yarn end preparation means for commencement of the yarn end preparation of the respective yarn package 2 supported on the tube support member 1. The entire extent of the intermediately located branch path is eventually loaded with a number of the tube support members 1 awaiting initial processing by the component 10'. At this point in the feeding operation, the next tube support member 1 being transported along the interconnecting path 4 is prevented from moving into the intermediately located branch path by the tube support members already filing the intermediate branch path. These tube support members 1, therefore, are transported further along the interconnecting path 4 to be fed to the outer branch path, which delivers these tube support members i to the first component 10'' of the yarn end preparation means associated therewith for initial yarn end processing.

The concurrent continuous operation of the belts associated with the common preliminary path 3, the interconnecting path 4, and the three branch paths ensures that the oncoming tube support members 1 are continuously fed to a respective one of the branch for transport to the associated yarn end preparation means.

The yarn end preparing assembly of the embodiment of FIG. 1 operates in a self-directed manner to distribute the tube support members among the three branch paths. As can be understood, in the event that each of the branch paths has been loaded with its full complement of the tube support members 1, the tube support members 1 back up along the interconnecting path 4 and, thereafter, back up along the common preliminary path 3 in the direction toward the yarn package receiving location.

The respective yarn end preparation means advance each tube support member 1 sequentially through its respective three components 10-12, 10'-12', and 10''-12'' for preparing the yarn end of the yarn package 2 supported on the respective advanced tube support member 1. The tube support member 1 then exits the third component 12,12' and 12'' which performs the final yarn end preparation step, for further transport therealong to the exit interconnecting path 8. The exit interconnecting path 8 transports the tube support members 1 to the common downstream exit path 9 for transport thereby to a prepared yarn package readiness location (not shown) at which the yarn packages 2 having their yarn ends disposed in preferred preliminary dispositions for unwinding engagement by the winding stations are collected for eventual supply to the winding stations.

Figure 2:
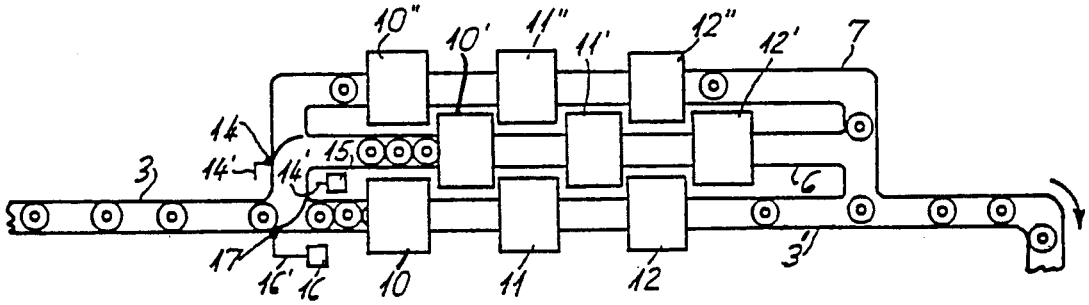
FIG. 2 is a schematic plan view of another embodiment of the yarn end preparing assembly of the present invention.

In FIG. 2, another embodiment of the yarn end preparing assembly of the present invention is illustrated with yarn end preparing assemblies having the same arrangement and operation of a common preliminary path 3, a supporting means comprising of an interconnecting path 4 and a plurality of branch paths each having a yarn end preparation means associated therewith, and an exit means comprising an exit interconnecting path 8 and a common downstream exit path as described above in relation to the embodiment illustrated in FIG. 1. Each branch path associated with a respective one of the yarn end preparation means is at a relatively smaller offset from an adjacent respective branch path and branch exit path than the branch paths in the embodiment in FIG. 1, which results in a configuration in which the interconnecting path 4 and the exit interconnecting path 8 have relatively smaller extents than their counterparts in the embodiment in FIG. 1. Each yarn end preparation means includes a plurality of components 10-12, 10'-12', and 10''-12'', identical in operation and structure to the components of the yarn end preparation means illustrated in the embodiment in FIG. I In this embodiment, however, the components of each yarn end preparation means are offset from the corresponding components of the adjacent yarn end preparation means. For example, the first component 10'' of the yarn end preparation means associated with the outermost branch path is offset from the first component 10' of the adjacent yarn end preparation means associated with the intermediately located branch path relative to the direction of advancement of the tube support members 1 through the yarn end preparation means. This offset arrangement permits the respective components of the yarn end preparation means to extend in partial side-by-side overlapping relation with respect to one another, thereby advantageously minimizing the space requirements of the yarn end preparing assembly.

Additionally, the embodiment of the yarn end preparing assembly illustrated in FIG. 2 includes a sensing means in the form of a conventional sensor 16 for sensing the presence of a tube support member 1 at a location on the branch path aligned with the common preliminary path 3. A diverting means in the form of a pivotable curved arm member 17 is operatively connected via a connector 16' to the sensor 16 for movement from a clearance position out of interference with the travel path of the tube support members 1 being transported between the common preliminary path 3 and the aligned branch path and a diverting position at an angle across the travel path for diverting the tube support members 1 to travel onto the interconnecting path 4. The pivotable arm member 17 is movable from its clearance position to its diverting position in response to the sensing by the sensor 16 of the relatively stationery condition of a tube support member 1 at the sensing location.

The sensor 16 is therefore capable of sensing the condition of a backup condition in which there are a predetermined number of the tube support members 1 on the aligned branch path which are awaiting initial yarn end processing by the first component 10 of the yarn end preparation means. The sensor 16 is preferably positioned for sensing the presence of a tube support member 1 at a location upstream from the first component 10 corresponding to the position at which a tube support member 1 would be temporarily stopped behind several other tube support members awaiting processing by the component 10. The sensor 16 senses that the respective tube support member 1 is relatively stationery—that is, that the respective tube support member 1 is not moving in the direction of advancement—and signals the pivotable arm member 17 by the connector 16' to move from its clearance position to its diverting position to divert the next oncoming tube support members 1 onto the interconnecting path 4. The interconnecting path 4 is thus operable to transport the diverted tube support members for feed to the intermediately located branch path or the other branch path.

The embodiment of FIG. 2 also includes a second diverting means in the form of a pivotable curved arm member 14 operatively connected via a connector 14' to the sensor 16. The pivotable arm member is movable from a clearance position out of interference with the travel path of the interconnecting path 4 to a diverting position at an angle across the travel path for diverting the tube support members 1 from the interconnecting path 4 onto the intermediately located branch path. The movement of the pivotable arm members 14,17 from their respective clearance positions to their respective diverting positions occurs contemporaneously so that the oncoming tube support members 1 diverted by the pivotable arm member 17 are subsequently diverted by the pivotable arm member 14 onto the intermediately located branch path.

The pivotable arm member 14 is operatively connected via a connector 14' to a second sensing means in the form of a conventional sensor 15 positioned along the travel path of the intermediately located branch path upstream of the first component 10' of the associated yarn end preparation means. The sensor 15 is operable to sense the stationery status of a tube support member at a sensing location corresponding to the location of a tube support member temporarily stopped behind a predetermined number of other tube support members 1 all awaiting initial yarn end preparation by the first component 10'. The sensor 15 senses that a respective tube support member 1 is remaining relatively stationery at the sensing location by sensing, for example, that the respective tube support member 1 has not moved in the direction of advancement for a predetermined duration, and transmits a signal via the connector 14' to the pivotable arm member 14. The pivotable arm member 14 responds to the signal from the sensor 15 by moving from its diverting position to its clearance position to allow subsequent oncoming tube support members 1 to travel on the interconnecting path 4 beyond the intermediately located branch path to the outermost branch path. This embodiment thus provides the capability of sequentially guiding the oncoming tube support members 1 initially to the aligned branch path, then to the intermediately located branch path and, thereafter, to the outer branch path in response to the sensed condition of a backup or predetermined number of tube support members 1 disposed on a respective branch path while awaiting initial yarn end preparation.

Figure 3:
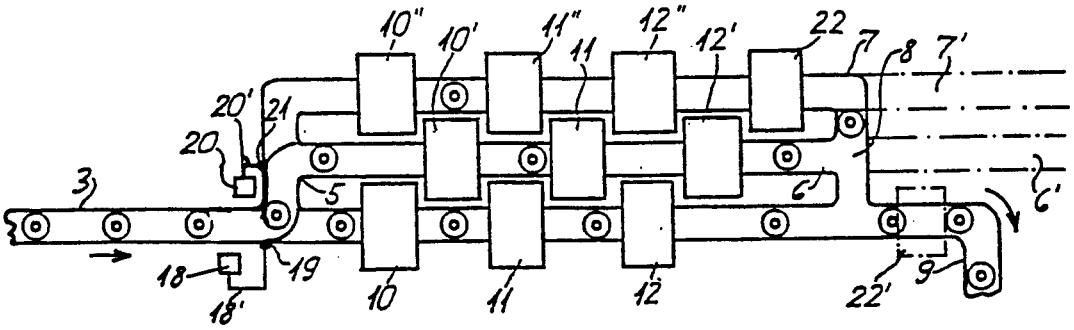
FIG. 3 is a schematic plan view of a further embodiment of the yarn end preparing assembly of the present invention.

In FIG. 3, a further embodiment of the yarn end preparing assembly of the present invention is illustrated. This yarn end preparing assembly is of the type having a common preliminary path 3, a supporting means comprising an interconnecting path 4 and a plurality of associated branch paths, an interconnecting exit path 8, a downstream exit path 9 and a plurality of yarn end preparation means associated with each branch path which operate as described with respect to the embodiment of the yarn end preparing assembly illustrated in FIG. 2. Each respective component of the yarn end preparation means is offset from the same respective component of an adjacent yarn end preparation means. For example, the first yarn end preparing component 10'' of the yarn end preparing means associated with the outermost branch path is offset in the direction of tube support member advance from the first yarn end preparing component 10' of the adjacent yarn end preparing means associated with the intermediately located branch path. A selected one of the yarn end preparing means such as, for example, the yarn end preparing means associated with the outermost branch path, has an auxiliary yarn end preparing component 22 for handling those yarn packages 2 having a predetermined characteristic different than other of the yarn packages 2. The auxiliary component 22 is positioned relative to the path of the tube support members 1 being advanced through the yarn end preparation means associated with the offset branch path for handling the yarn packages 2 after they have been sequentially handled by the three primary components 10'',11'' and 12'' of the associated yarn end preparation means.

As seen in FIG. 10, the auxiliary yarn end disposing device 22 includes a plurality of rotating disk members 42 supported on a conventional manipulating device such as, for example, a solenoid or motor driven pivot arm for selectively moving the disk members from clearance positions clear of the travel of the tube support members along the advancing path and retaining positions in the path of advancing tube support members to selectively retain and release tube support members at a yarn end disposing location relative to the auxiliary yarn end disposing device 22. This auxiliary yarn end disposing device 22 includes a suction chamber 50 having a bell-shaped bottom portion 43. A light source 44 and a conventional photoelectric cell 45 are disposed across from each other in the bell-shaped portion 43 adjacent its mouth. A conventional yarn end cutting device 49 is disposed in the suction chamber 50 upstream from the bell-shaped portion 43 relative to the direction of suction applied through the suction chamber. A sensor 46 is disposed downstream within the bell-shaped member 43 adjacent the yarn end cutting device 49. The suction chamber 50 is movably mounted on a vertical post 48 for selective vertical movement therealong. A drive motor 47 is operable to selectively adjustably position the suction chamber 50 relative to the post 48.

In operation, the rotating disk members 42 are moved into engagement with a tube support member 1 transported to the auxiliary yarn end disposing device 22 along the advancing path to retain the tube support member at a yarn end disposing location. The motor 47 is operated to lower the suction chamber 50 into yarn end engaging disposition in which the bell-shaped portion 43 is disposed over a top portion of the yarn package supported on the tube support member 1. The rotating disk members 42 are rotated in correspondence with one another in engagement with the circumferential periphery of the tube support member 1 to rotate the supported yarn package in an unwinding direction while suction is applied to the yarn package through the suction chamber 50. The lowering of the suction chamber 50 over the top of the yarn package is controlled through sensing by the photoelectric cell 45 of an interruption of the transmission of light from the light source 44 as the yarn package moves between the photoelectric cell 45 and the light source 44. The sensor 46 senses the presence of the yarn end in the suction chamber 50 and controls the operation of the yarn end cutting device 49 to cut the yarn end. Thereafter, the rotating disk members 42 are reversely rotated to effect rotation of the yarn package in a winding direction to wind the now-cut yarn end back onto the yarn package in a preferred preliminary disposition.

The auxiliary yarn end preparation device 22 thus provides the capability to more thoroughly handle those yarn packages 2 of a predetermined characteristic. For example, a quality control check of the yarn packages 2 being unwound at the winding stations of the winding machine may reveal that those yarn packages 2 which were produced in a particular batch at the spinning machine or at the end of a batch or at a particular spinning station tend to have a higher than average incidence of unsuccessful yarn end preparation. In response to this observation, the operator can configure the yarn end preparing assembly to guide the tube support members 1 supporting those yarn packages 2 of the particular characteristic to the outermost branch path to ensure that each of the yarn packages 2 receives the more thorough handling of the auxiliary yarn end preparation device 22.

The embodiment of the yarn end preparing assembly illustrated in FIG. 3 can additionally include the modification of batch sensing means in the form of a first batch sensor 18 and a second batch sensor 20. The first batch sensor 18 is disposed relative to the common preliminary path 3 for sensing a conventional batch identification component secured to a selected one of the tube support members 1 and the yarn packages 2 traveling therepast. The conventional batch identification component can be, for example, a color marking secured to the yarn package 2 and the first batch sensor 18 and the second batch sensor 20 can be configured as conventional color sensors for distinguishing among the colors associated with each respective batch of the yarn packages 2 produced at the spinning machine. A diverting means in the form of a pivotable curved arm member 19 is disposed relative to the common preliminary path 3 downstream from the sensing location at which the first batch sensor 18 senses the tube support members 1. The pivotable arm member 19 is operatively connected to the first batch sensor 18 by a connector 18' for receiving signals from the first batch sensor. The pivotable arm member 19 is pivotable in response to a signal from the first batch sensor 18 from a clearance position out of interference with the travel of the tube support members from the common preliminary path 3 onto the aligned branch path to a diverting position at an angle across the travel path of the tube support members 1 for diverting the tube support members onto the interconnecting path 4.

The second batch sensor 20 is disposed relative to the interconnecting path 4 for sensing the conventional batch identification component secured to the selected one of the tube support members 1 and the yarn packages 2 traveling therepast and is operatively connected via a connector 20' to a diverting means in the form of a pivotable curved arm member 21. The pivotable arm member 21 is disposed relative to the interconnecting path 4 for diverting the tube support members 1 at a location downstream of the sensing location at which the second batch sensor 20 senses the conventional batch identification components. The pivotable arm member 21 is pivotable in response to a signal from the second batch sensor 20 between a clearance position out of interference with the travel of the tube support members 1 along the interconnecting path 4 and a diverting position across the travel path for diverting the tube support members 1 from the interconnecting path 4 onto the intermediately located branch path.

The first batch sensor 18 and the second batch sensor 20 operate as follows to selectively guide the tube support members 1 supporting the respective yarn packages 2 of each respective yarn batch to the yarn end preparing means dedicated to the preparation of the yarn packages from the respective yarn batch. The first batch sensor 18 senses the conventional batch identification component of each tube support member 1 (or, respectively, the yarn package 2 supported thereon) being transported along the common preliminary path 3. If the first batch sensor 18 senses that the respective yarn package 2 was not produced by the particular yarn batch which is to be exclusively handled by the yarn end preparation means associated with the aligned branch path, the first batch sensor 18 signals the pivotable arm member 19 via the connector 18' to move from its clearance position to its diverting position to divert the respective tube support member I supporting the sensed yarn package 2 onto the interconnecting path 4. The conventional batch identification means on the diverted tube support member 1 (or, respectively, on the yarn package 2 supported thereon) is then sensed by the second batch sensor 20. If the second batch sensor 20 determines that the sensed yarn package 2 was not produced in the batch whose yarn packages are to be exclusively handled by the yarn end preparation means associated with the intermediate offset branch path, the second batch sensor 20 signals the pivotable arm member 21 to move from its clearance position to its diverting position to divert the respective tube support member 1 from the interconnecting path 4 onto the intermediate branch path. Those yarn packages 2 which were not produced in the batch for which the yarn end preparation means associated with the intermediate branch path exclusively handles, are permitted to travel further along the interconnecting path 4 to the outer branch path. In this regard, the pivotable arm member 21 remains in its clearance position to permit the travel therepast of the tube support members 1 supporting these yarn packages 2.

The yarn end preparing assembly of FIG. 3 can thus subject the yarn packages 2 of each respective batch from a spinning machine to a predetermined type of yarn end preparation which is best suited for the yarn packages. Additionally, the embodiment of FIG. 3 can be provided with means for maintaining the yarn packages 2 of each respective batch segregated from one another following their yarn end preparation in the respective yarn end preparation means. In this configuration, the yarn end preparing assembly could be provided with additional separate tube support member paths operatively connected to the branch exit paths for maintaining the yarn packages 2 of each batch separate from the yarn packages of the other batches. For example, an auxiliary exit path 6' can be operatively connected to the intermediately located branch path for transporting the tube support members 1 supporting those yarn packages 2 of the batch which has been handled by the components 10',11' and 12' of the yarn end preparation means of the intermediate branch exit path for transport of the tube support members 1 to a particular yarn package supply location. An auxiliary exit path 7' can be operatively connected to the outer branch path for transporting the tube support members 1 supporting those yarn packages 2 which have been handled by the components 10'',11'' and 12'' of the outer branch path for transport to a particular yarn package supply location.

The embodiment of FIG. 3 can be further modified to include a remedial yarn end preparation component 22' disposed relative to the common downstream exit path 9 for handling the yarn packages 2 supported on the tube support members 1 transported along the common downstream exit path. The remedial yarn end preparation component 22' can be identical in structure and operation to the auxiliary yarn end preparation device 22 described above for more thoroughly handling selected ones of the yarn packages 2 to dispose their yarn ends in preferred preliminary dispositions for unwinding. In this regard, the third components 12 and 12', which perform the final yarn end preparation step of their respective yarn end preparation means, can each be provided with a conventional sensor (not shown) which senses if the yarn end of a yarn package 2 has been successfully disposed in a preferred preliminary disposition by the respective yarn preparation means. These sensors can be operatively connected to the remedial yarn end preparation component 22' to signal the remedial yarn end preparation component that a particular yarn package 2 exiting the respective yarn end preparation means has not had its yarn end successfully disposed in a preferred preliminary disposition. The remedial yarn end preparation component 22' can then more thoroughly handle the respective yarn package 2 to remedy the unsuccessful effort of the respective yarn end preparation means to dispose the yarn end of the yarn package in a preferred preliminary disposition. In this regard, conventional time delay control means (not shown) can be provided to control the operation of the remedial yarn end preparation component 22' in a time delay manner corresponding to the amount of travel time necessary for the respective yarn package 2 which requires remedial treatment to be transported from the respective third component 12,12' to the remedial yarn end preparation component 22'. The third component 12'' of the yarn end preparation means associated with the outer branch path can also be provided with a conventional sensor operatively connected to the remedial yarn end preparation component 22' in the event that the yarn end preparation means does not include the above-described auxiliary yarn end preparation device 22.

In a further modification of the embodiment of the yarn end preparing assembly illustrated in FIG. 3, the third component 12'', which performs the final yarn end preparation step of the yarn end preparation means associated with the outer branch path, can include a conventional sensor (not shown) for sensing if the yarn end of a yarn package 2 has been disposed in a preferred preliminary disposition. The conventional sensor can be operatively connected to the auxiliary yarn end preparation device 22 for controlling the operation of the auxiliary yarn end preparation device to prepare the yarn ends of those yarn packages 2 which have been identified as yarn packages whose yarn ends have not been successfully disposed in a preferred preliminary disposition despite the handling of the yarn package by the first three components 10'',11'' and 12''.

Figure 4:
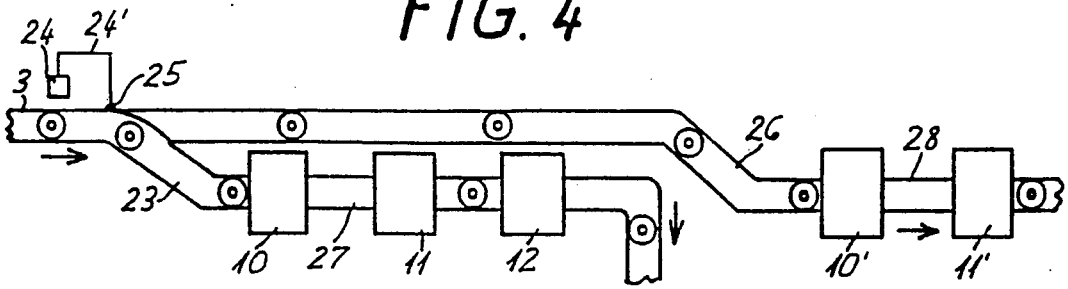
FIG. 4 is a schematic plan view of an additional embodiment of the yarn end preparing assembly of the present invention.

An additional embodiment of the yarn end preparing assembly of the present invention is illustrated in FIG. 4 and includes a delivery means comprising a common preliminary path 3 for commonly transporting the tube support members 1 from the yarn package receiving location toward the winding stations of the winding machine. The assembly also includes a supporting means comprising a pair of intermediate paths 23,26 which each branch from the common preliminary path 3. Each of the intermediate paths 23,26 supports tube support member 1 at a yarn end preparation means having three components 10-12 and 10'-12' by means of a conventional advancing means in the form of a flexible endless belt 2? ,28 for advancing tube support members 1 through the yarn end preparing components 10-12, 10'-12'. The initial portion of one of the intermediate paths 26 is aligned with the common preliminary path 3.

Figure 5:
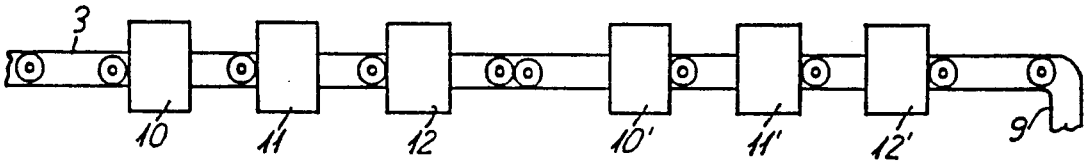
FIG. 5 is a schematic plan view of yet another embodiment of the yarn end preparing assembly of the present invention.

A sensing means in the form of a conventional presence sensor 24 is disposed relative to the common preliminary path 3 for sensing the travel of the tube support members 1 at a sensing location upstream of the junction at which the intermediate paths 23,26 branch from the common preliminary path 3. A branch guiding means in the form of a pivotable curved arm member 25 is operatively connected via a connector 24' to the presence sensor 24 and is movable from a first position out of interference with the travel of the tube support members 1 through the junction to intermediate path 26 aligned with the common preliminary path and a second position in which it extends at an angle across the junction for diverting the tube support members 1 from the common preliminary path 3 to the other intermediate path 23. The presence sensor 24 can be configured, for example, to sense a conventional batch identification component secured to each yarn package 2 to control the pivotable arm member to effect guiding of the yarn packages 2 to a respective one of the intermediate paths 23,26 in correspondence with the respective batch in which the yarn package was produced Yet another embodiment of the yarn end preparing assembly of the present invention is illustrated in FIG. 5 and includes a common preliminary path 3 along which the tube support members I are transported from the yarn package receiving location. The assembly also includes a supporting means comprising a single common path aligned with the common preliminary path 3 and extends, therefrom through a pair of yarn end preparation means to an exit means comprising a downstream exit path 9.) The two yarn end preparation means, which include the same three components 10-12 and 10'-12', described above, are sequentially disposed along the single common path of the supporting means for preparing the yarn ends of the yarn packages 2 supported on the tube support members 1 transported therealong. The embodiment of FIG. 5 can include conventional control means (not shown) operatively connected to the pair of yarn end preparation means for controlling their operations. In this regard, the conventional control means can control the components 10,11 and 12 of the upstream yarn end preparation means to permit a predetermined number of tube support members 1 to travel therethrough without receiving yarn end processing and the yarn packages 2 supported on these through-traveling tube support members 1 can then be processed by the components 10',11' and 12' of the downstream yarn end preparation means while a subsequent number of tube support members are being processed by the components 10,11 and 12 of the upstream yarn end preparation means to handle the yarn packages 2 supported on a predetermined number of subsequently following tube support members 1, following which the control means can control the downstream yarn preparation means to allow those tube support members processed by the upstream yarn end preparing means to pass through without further processing.

Figure 6:
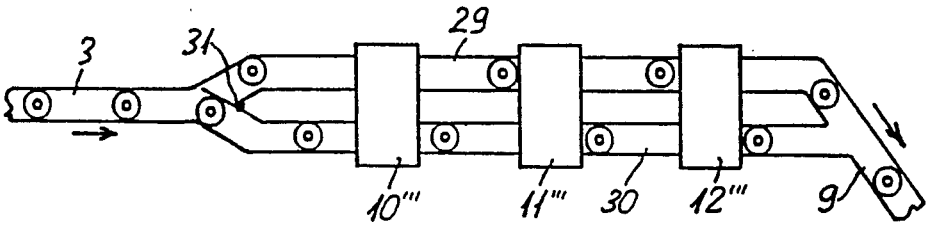
FIG. 6 is a schematic plan view of a further additional embodiment of the yarn end preparing assembly of the present invention.

A further additional embodiment of the yarn end preparing assembly of the present invention is illustrated in FIG. 6 and includes a common preliminary path 3 for the transport of the tube support members 1 from the yarn package receiving location. The assembly also includes a supporting means comprising a pair of branch paths 29,30 branched from a common junction with the common preliminary path 3 and each path 29,30 includes a linearly extending portion parallel to the linearly extending portion of the other branch path The ends of the linearly extending portions of the branch paths 29,30 merge into a common downstream exit path 9.

A yarn end preparation means having a plurality of components 10''',11''' and 12''' is disposed in cooperative relationship with both of the branch paths 29,30 for preparing yarn ends of different packages being transported in both branch paths 29. The components 10'''-12''' are located at successively further downstream locations along the branch paths 29,30 for sequentially handling the yarn packages 2. Each component 10'''-12''', for example, can be configured to handle the yarn packages 2 on each of the branch paths 29,30 in alternating manner.

A conventional gate member 31 can be located relative to the junction of the branch paths 29,30 and the common preliminary path 3 for selectively guiding the oncoming tube support members I onto each respective branch path. A conventional control unit (not shown) can be operatively connected to the gate member 31 to control the operation of the gate member. The gate member 31 can be controlled, for example, to guide every other oncoming tube support member 1 onto a respective one of the branch paths 29,30.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. In a textile winding machine of the type having a plurality of winding stations at which yarn is wound from yarn packages built on tubes which are individually supported on tube support members during transport of the yarn packages to and from the winding stations, an assembly for preparing the yarn ends of the yarn packages for unwinding engagement at the winding stations, comprising:

a first yarn end preparation means operable to completely prepare the yarn end of a first yarn package supported on a first tube support member for subsequent engagement of the yarn end at one of the winding stations;

a second yarn end preparation means operable to completely prepare the yarn end of a second yarn package supported on a second tube support member for subsequent engagement of the yarn end at one of the winding stations, said second yarn package being different than said first yarn package and said first and second yarn end preparation means being operable concurrently to prepare the yarn ends of said first and second yarn packages;

means for supporting said first tube support member at said first yarn end preparation means during yarn end preparation of said first yarn package and for supporting said second tube support member at said second yarn end preparation means during yarn end preparation of said second yarn package, said supporting means including first temporary retaining means for selectively retaining said first tube support member at said first yarn end preparation means during the yarn end preparation of said first yarn package thereat and second temporary retaining means for selectively retaining said second tube support member at said second yarn end preparation means during yarn end preparation of said second yarn package thereat, said first and second temporary retaining means being operable independently of one another;

delivery means defining a common delivery path along which all of said first and second tube support members are transported to said supporting means; and exit means defining at least one exit path, said exit means for transporting said first tube support member with said first yarn package thereon from said first yarn end preparation means along said exit path, and for transporting said second tube support member with said second yarn package thereon from said second yarn end preparation means, to the winding stations for individual winding of said first yarn package at any selected one of the winding stations and for individual winding of said second yarn package at any selected one of the winding stations.

2. In a textile winding machine, the assembly according to claim 1 and characterized further in that said supporting means includes a first branch path and an interconnecting path, said first branch path extending through said first yarn end preparation means and having an upstream end connected to said interconnecting path and said interconnecting path having an upstream end connected to a downstream end of said common delivery path, whereby said interconnecting path interconnects said first branch path with said common delivery path for transporting said first and second tube support members from said common delivery path to said first branch path.

3. In a textile winding machine, the assembly according to claim 2 and characterized further by a second branch path extending through said second yarn end preparation means and characterized further in that said branch paths extend generally parallel to one another through said first and second yarn end preparation means.

4. In a textile winding machine, the assembly according to claim 3 and characterized further in that each of said first and second yarn end preparation means includes a plurality of components arranged for sequential individual handling of yarn packages transported through said yarn end preparation means.

5. In a textile winding machine, the assembly according to claim 4 and characterized further in that the same respective components of said first and second yarn end preparations means are generally aligned with one another transverse to the direction of travel of said first and second tube support members through said first and second yarn end preparation means.

6. In a textile winding machine, the assembly according to claim 4 and characterized further in that the components of said first yarn end preparation means are offset from the same respective components of said second yarn end preparation means relative to the direction of travel of the tube support members through said first and second yarn end preparation means.

7. In a textile winding machine, the assembly according to claim 4 and characterized further in that said second branch path is aligned with said common delivery path.

8. In a textile winding machine, the assembly according to claim 7 and characterized further by sensing means located adjacent said second aligned branch path upstream from the respective yarn end preparation means associated with said second aligned branch path for sensing the presence of a tube support member at a predetermined location upstream of the respective yarn end preparation means, and diverting means, operatively connected to said sensing means, for diverting tube support members onto said interconnecting path in response to sensing by said sensing means of a tube support member at said predetermined upstream location.

9. In a textile winding machine, the assembly according to claim 8 and characterized further by second sensing means located relative to said first branch path for sensing the presence of a tube support member at a second sensing location, and second diverting means operatively connected to said second sensing means, for diverting tube support members from said interconnecting path onto said first branch path in response to the sensing by said second sensing means of a tube support member at said second sensing location.

* * * * *